US006814307B2

(12) United States Patent
Hurley et al.

(10) Patent No.: US 6,814,307 B2
(45) **Date of Patent: *Nov. 9, 2004**

(54) LOW NOX LIQUID FUEL OIL ATOMIZER SPRAY PLATE AND FABRICATION METHOD THEREOF

(75) Inventors: John F. Hurley, Easton, CT (US); John N. Dale, Stratford, CT (US)

(73) Assignee: Combustion Components Associates, Inc., Monroe, CT (US)

( * ) Notice: Subject to any disclaimer, the term of this patent is extended or adjusted under 35 U.S.C. 154(b) by 357 days.

This patent is subject to a terminal disclaimer.

(21) Appl. No.: 10/057,341

(22) Filed: Jan. 24, 2002

(65) Prior Publication Data

US 2003/0136860 A1 Jul. 24, 2003

(51) Int. Cl.[7] ..... B05B 1/34
(52) U.S. Cl. ..... 239/492; 239/463; 239/601
(58) Field of Search ..... 239/461, 463, 239/490–494, 601

(56) References Cited

U.S. PATENT DOCUMENTS 4,087,050 A * 5/1978 Tsuji et al. ..... 239/490
5,067,655 A * 11/1991 Farago et al. ..... 239/124
5,435,884 A * 7/1995 Simmons et al. ..... 216/100
5,622,489 A 4/1997 Monro
5,713,205 A * 2/1998 Sciocchetti et al. ..... 60/740
5,775,588 A * 7/1998 Hallstrom et al. ..... 239/127
5,826,798 A * 10/1998 Schindler et al. ..... 239/403
6,024,301 A 2/2000 Hurley et al.
6,394,366 B1 * 5/2002 Adams ..... 239/463
6,561,440 B1 * 5/2003 Hofherr ..... 239/472
6,622,944 B1 * 9/2003 Hurley et al. ..... 239/426

* cited by examiner

*Primary Examiner*—Michael Mar
*Assistant Examiner*—Thach H. Bui
(74) *Attorney, Agent, or Firm*—Barry R. Lipsitz; Douglas M. McAllister

(57) ABSTRACT

An atomizer spray plate is provided for discharging fuel oil. The spray plate has a cylindrical rear portion and a conical front portion. A frusto-conical whirl chamber extends from the rear portion to the front portion with a decreasing radius. The rear portion includes a number of whirl slots extending radially inward from an outboard region of the rear portion to the whirl chamber to provide the fuel oil with rotational energy. A discharge slot is provided in the front portion of the spray plate for receiving fuel oil from the whirl chamber with rotational energy. The discharge slot includes a cylindrical through-hole with a diameter d, and at least three lobes (slots) equally spaced about the through-hole and oriented in a radial direction, each lobe having a semi-circular cross-section with radius r and extending approximately perpendicular to a central longitudinal axis of the through-hole.

28 Claims, 11 Drawing Sheets

LOW NOX LIQUID FUEL OIL ATOMIZER SPRAY PLATE AND FABRICATION METHOD THEREOF

BACKGROUND OF THE INVENTION

The present invention relates to an atomizer spray plate of a fuel oil atomizer for pressure-type atomization systems, including spill return systems, and simplex, or "once-through" systems.

For environmental and economical reasons, there is an ongoing need to improve the efficiency of fuel oil atomizers which supply fuel oil to a furnace. It is known that the formation of oxides of nitrogen (NOx) can be slowed by providing fuel-rich and fuel-lean zones in the atomizing spray pattern. Such a fuel spray pattern can be achieved by imparting a rotational momentum, or swirl, to the fuel as it exits the atomizer, and by shaping the fuel spray in a specific manner.

For example, U.S. Pat. No. 5,622,489 to Monro discloses a fuel atomizer with an oblong discharge slot that is shaped to achieve a spray pattern with fuel-rich zones that are spaced apart from one another and separated by a central fuel-lean zone. However, the shaping of the oblong slot is rather complex as the width and angle of the walls of the slot must be precisely set.

Commonly owned U.S. Pat. No. 6,024,301 to Hurley (the "Hurley patent") provides an improvement over the design of U.S. Pat. No. 5,622,489 to Monro. The Hurley patent provides a low NOx fuel oil atomizer with an atomizer spray plate having an oblong transverse discharge slot that provides a spray pattern with fuel-rich and fuel-lean zones, yet does not require complex machining of the discharge slot. The Hurley patent also provides a method for fabricating such an atomizer spray plate. Furthermore, the fuel oil atomizer of the Hurley patent is compatible with pressure-type atomization systems, including spill return systems and simplex systems. While the atomizer of the Hurley patent provides improvements over prior art atomizers, the transverse discharge slot results in a flame length which may be too long for use in some restrictive furnace designs.

It would be advantageous to improve upon the atomizer design provided by the commonly owned Hurley patent. It would be further advantageous if such a design provides for similar or improved reductions in NOx emissions, while providing flexibility for a variety of applications. It would be further advantageous to provide an atomizer design having shorter flame lengths for use in applications where the furnace geometry is restrictive.

The present invention provides apparatus and methods having the above and other advantages.

SUMMARY OF THE INVENTION

The present invention relates to an atomizer spray plate of a fuel oil atomizer for pressure-type atomization systems, including spill return systems, and simplex, or "once-through" systems.

An atomizer spray plate for discharging fuel oil in accordance with the present invention includes a generally cylindrical rear portion and a generally conical front portion. A frusto-conical whirl chamber extends from the rear portion to the front portion with a decreasing radius. A central longitudinal axis extends through the whirl chamber. Preferably, the rear portion includes a number of whirl slots extending radially inward from an outboard region of the rear portion to the whirl chamber. The whirl slots receive fuel oil at the outboard region and supply the fuel oil to the whirl chamber with a rotational energy.

A discharge slot is provided in the front portion of the atomizer spray plate for receiving the fuel oil from the whirl chamber with the rotational energy.

In particular, the discharge slot includes a cylindrical through-hole with a diameter d. A central longitudinal axis of the through-hole is co-linear with the central longitudinal axis of the whirl chamber. That is, the through-hole is aligned with the whirl chamber.

The discharge slot also includes at least three lobes (i.e. slots) equally spaced about the through-hole and oriented in a radial direction, each lobe having a semi-circular cross-section with radius r. The lobes extend approximately perpendicular to the central longitudinal axis of the cylindrical through-hole.

Advantageously, the discharge slot can be easily and economically fabricated with two shaping steps. Furthermore, there is no need to precisely set any particular non-right angle for walls of the discharge slot. Yet, the discharge slot provides a spray pattern with lateral fuel-rich zones separated by a central fuel-lean zone. This spray pattern has been demonstrated by testing to reduce the peak combustion flame temperature, thereby inhibiting the formation of harmful NOx combustion byproducts.

The front portion of the atomizer spray plate preferably has a generally conical front surface surrounding the discharge slot and sloping at a particular angle, for example between 75 and 85 degrees, relative to the central longitudinal axis of the cylindrical through-hole.

Furthermore, the radius r is selected to be slightly greater than d/2. The lobes are provided at a depth in the front portion to form a desired primary spray angle $\alpha$ that is defined by a tangent line to the lobes at a forward-most point of the front portion of the spray plate. A secondary spray angle is achieved along a length-wise direction of each lobe.

Preferably, the depth of the lobes is approximately $r(1-\sin(\alpha/2))$, the desired primary spray angle $\alpha$ is approximately 20° to 40°, and $r=d/(2*\cos(\alpha/2))$.

In a particular embodiment of the invention, three lobes are equally spaced about the through-hole and oriented in the radial direction. In such an embodiment, a developed secondary spray angle of approximately 35° to 45° may be achieved along a length-wise direction of each of the three lobes.

In an alternate embodiment, four lobes are provided, which are equally spaced about the through-hole and oriented in a radial direction to form two pairs of diametrically opposed lobes. In a four lobe embodiment, a developed secondary spray angle of approximately 70°–90° may be achieved along a length-wise direction of each pair of lobes.

Optionally, a portion of the fuel oil in the whirl chamber is returned to a fuel oil supply instead of being supplied to the discharge slot.

Preferably, a ratio "A"/($d*D_2$) is in a range from approximately 0.4 to approximately 0.6, "A" is a total flow area of the whirl slots, and $D_2$ is a diameter of the whirl chamber at a point where the fuel oil is supplied to the whirl chamber from the whirl slots.

Furthermore, a method is presented for fabricating an atomizer spray plate for discharging fuel oil. The method includes the steps of: providing an atomizer spray plate having a rear portion and a front portion, providing a whirl chamber extending from the rear portion to the front portion, where the whirl chamber has a central longitudinal axis extending therethrough, and providing a discharge slot in the front portion for receiving fuel oil from the whirl chamber.

The discharge slot is obtained by providing (a) a cylindrical through-hole with a diameter d having a central longitudinal axis that is co-linear with the central longitudinal axis of the whirl chamber, and (b) at least three lobes equally spaced about the through-hole and oriented in a radial direction, each lobe having a semi-circular cross-section with radius r and extending approximately perpendicular to the central longitudinal axis of the cylindrical through-hole.

The rear portion of the atomizer spray plate is provided with a plurality of whirl slots extending radially inward from an outboard region of the rear portion to the whirl chamber to receive fuel oil and provide it to the whirl chamber with a rotational energy. The fuel oil is then provided to the discharge slot via the whirl chamber.

Those skilled in the art should appreciate that the particular dimensions of the atomizer provided herein are exemplary only. The dimensions and spray angles may be dependent on the furnace application (e.g., constraints of the furnace geometry) and/or the results desired, for example, there may be tradeoffs between NOx emissions, flame length requirements, fuel efficiency, and the like. These variables may be controlled by varying the number of lobes, the spray angles, and other atomizer dimensions. For example, the transverse slot of the Hurley patent may be viewed as a single pair of two diametrically opposed lobes. A three lobe embodiment of the present invention will provide a shorter flame length as compared with the two lobe design of the Hurley patent. Similarly, a four lobe embodiment of the present invention (e.g., two pairs of diametrically opposed lobes) will provide an even shorter flame length than that provided by the three lobe embodiment.

BRIEF DESCRIPTION OF THE DRAWINGS

FIG. 1(*b*) is a front view of the atomizer of FIG. 1(*a*) in accordance with the present invention;

FIG. 2(*b*) is a side cross-sectional view of a whirl slot of the atomizer spray plate of FIG. 2(*a*) in accordance with the present invention;

FIG. 3(*b*) is a front view of a discharge slot of the atomizer spray plate of FIG. 1(*a*) in accordance with the present invention;

FIG. 5(*b*) is a front view of the atomizer of FIG. 5(*a*) in accordance with the present invention;

FIG. 6(*b*) is a front view of a discharge slot of the atomizer spray plate of FIG. 5(*a*) in accordance with the present invention.

DETAILED DESCRIPTION OF THE INVENTION

The present invention relates to an atomizer spray plate of a fuel oil atomizer for pressure-type atomization systems, including spill return systems, and simplex, or "once-through" systems.

Figure 1A:
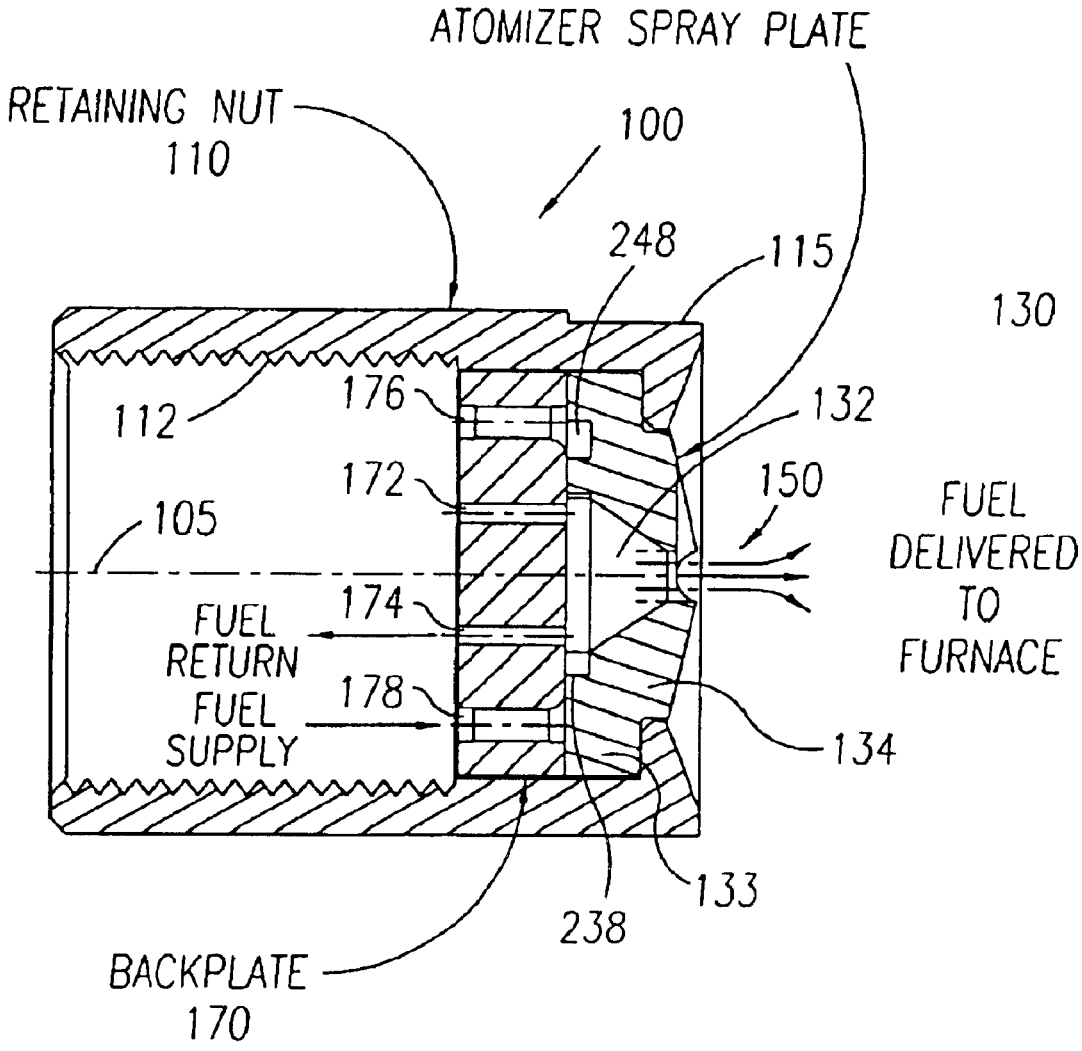
FIG. 1(*a*) is a side cross-sectional view of a three lobe embodiment of an atomizer in accordance with the present invention.
Figure 1B:
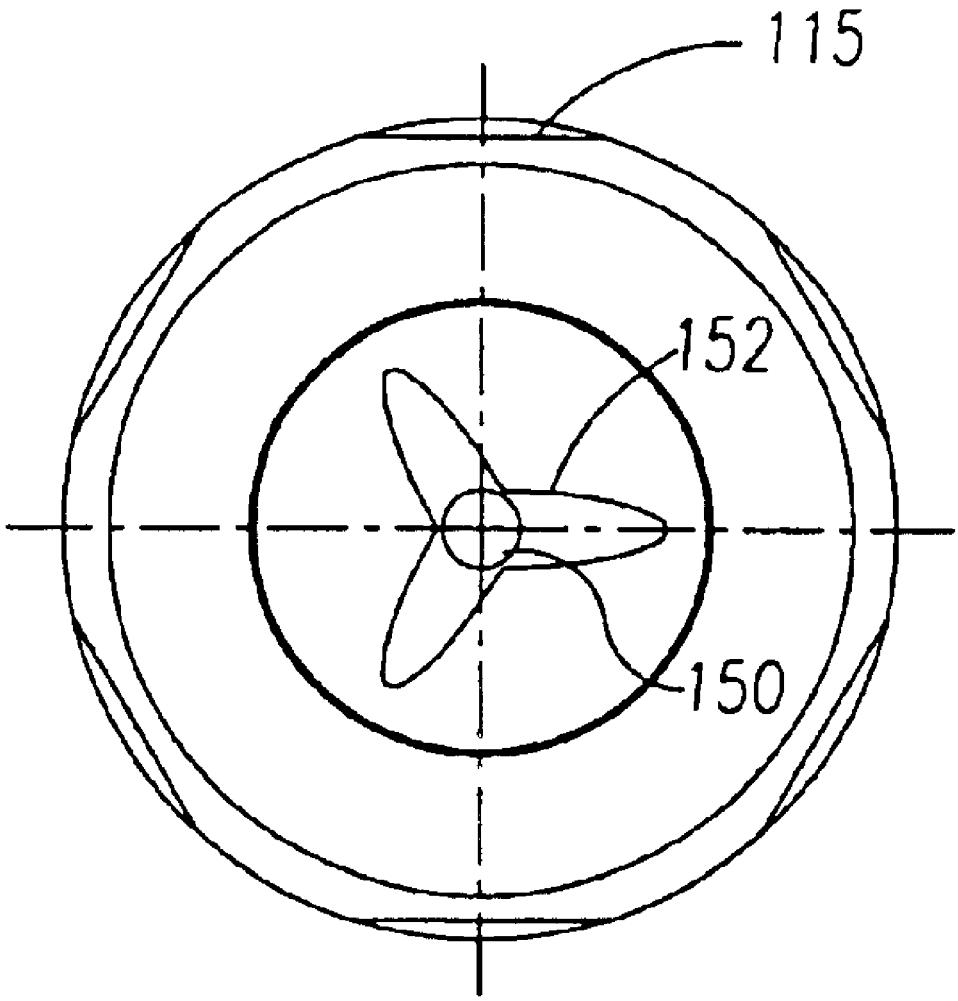

FIG. 1(*a*) is a side cross-sectional view of an example embodiment of an atomizer in accordance with the present invention. The atomizer, shown generally at 100, includes a retaining nut 110, a backplate 170, and an atomizer spray plate 130. The retaining nut 110 is generally cylindrical, and includes an interior threaded portion 112 for fastening the retaining nut to an oil gun in a known manner. The backplate 170 fits within the retaining nut 110, and includes a number of circumferentially arranged fuel supply ports, e.g., including supply ports 176 and 178 shown in the cross-section, and a number of circumferentially arranged fuel return ports, e.g., including ports 172 and 174.

The atomizer spray plate 130 includes a cylindrical rear portion 133 and a generally conical front portion 134. The front portion 134 includes a discharge slot 150 in accordance with the present invention for delivering a fuel spray to a furnace. Furthermore, in the profile view of FIG. 1(*a*), a portion of whirl slots 238 and 248 are shown. The whirl slots are discussed in further detail in connection with FIGS. 2(*a*) and 2(*b*), below.

In operation, pressurized fuel is supplied via the fuel supply ports, including ports 176 and 178. The fuel enters a number of whirl slots of the atomizer spray plate 130, including whirl slots 238 and 248, at the radially outboard location proximate to the ports 176 and 178. The fuel travels radially inward toward the longitudinal axis 105, through a frusto-conical whirl chamber 132, and through the discharge slot 150. A portion of the fuel in the whirl slots returns to the fuel supply via the fuel return ports, e.g. including ports 172 and 174.

FIG. 1(*b*) is a front view of the atomizer of FIG. 1(*a*) in accordance with the present invention. The cylindrical discharge slot 150 of the atomizer 100 may be created by drilling a cylindrical through-hole in the atomizer spray plate 130. Three or more lobes 152 (e.g., transverse to the longitudinal axis 105) may be provided in the atomizer spray plate 130 to shape the discharge slot 150 to provide the desired spray pattern with spaced apart fuel-rich zones and a central fuel-lean zone. The lobes 152 are equally spaced about the through-hole and orientated in a radial direction. In the example embodiment shown in FIGS. 1(*a*) through 2(*d*), three lobes 152 are shown equally spaced about the through-hole and oriented in a radial direction.

A number of wrench contact surfaces, e.g., including surface 115, may be provided at the circumference of the retaining nut 110.

Figures 2A, 2B:
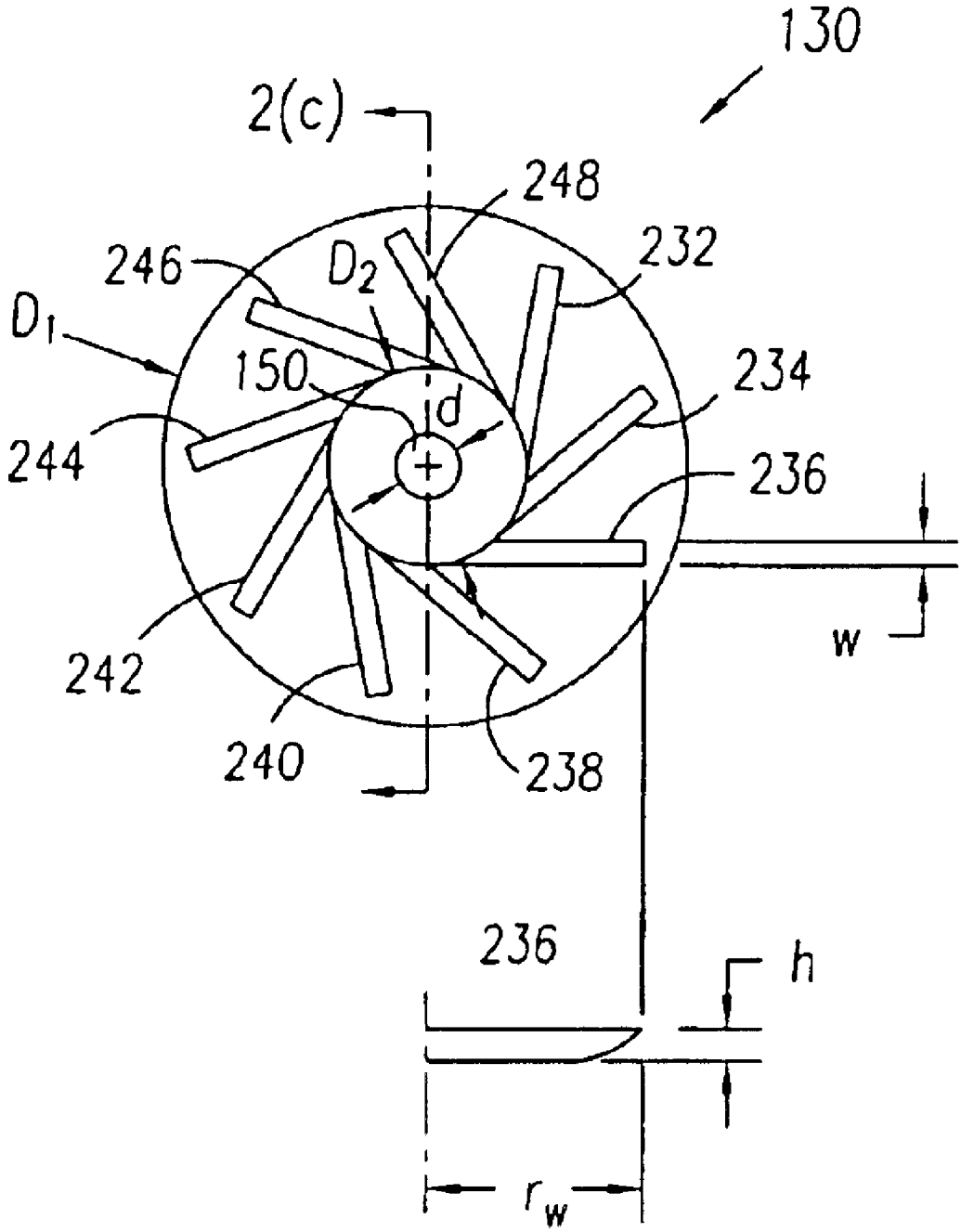
FIG. 2(*a*) is a back view of an atomizer spray plate in accordance with the present invention.

FIG. 2(*a*) is a back view of an atomizer spray plate 130 in accordance with the present invention. The atomizer spray plate 130 has an outer diameter $D_1$, an inner whirl slot diameter $D_2$, and a discharge slot or hole diameter d. The diameter $D_2$ is the diameter of a base portion 135 of the whirl chamber 132 (see FIG. 3(*a*)), while the discharge slot diameter d is the diameter of a tip portion of the whirl chamber 132.

The whirl slots 232, 234, 236, 238, 240, 242, 244 and 246 are preferably arranged tangentially to the diameter $D_2$ of the base portion 135. Each whirl slot has a width w. The whirl slots may be cut into a smooth face of a cylindrical disk using a cutting wheel having a width w.

Preferably, approximately nine (9) whirl slots are provided, although the number may vary depending on the application. Nine whirl slots have been used successfully in a prototype atomizer spray plate tested by the present inventors.

FIG. 2(*b*) is a side cross-sectional view of a whirl slot of the atomizer spray plate of FIG. 2(*a*) in accordance with the present invention. Each whirl slot, e.g., such as whirl slot 236, has a height h and a radius $r_w$. The height refers to a distance in the direction of the longitudinal axis 105 of FIG. 1(*a*). The curvature at the whirl slot 236 along its radius is determined by the radius of the cutting wheel used to fabricate the slot.

Note that, for a given $D_1$, a larger diameter $D_2$ increases the energy imparted to the fuel by the whirl slots.

The height h of each whirl slot is preferably equal to 1.2 to 1.3 times the width w. Furthermore, the ratio of $A/(d*D_2)$ should be in the range of approximately 0.4 to 0.6, where A=N*w*h is the total flow area of the N whirl slots. For example, A=9*w*h when nine whirl slots are used. As mentioned, $D_2$ is the diameter of the base portion 135 of the frusto-conical whirl chamber 132, which acts as a spin chamber for the fuel oil received from the whirl slots.

Figure 3A:
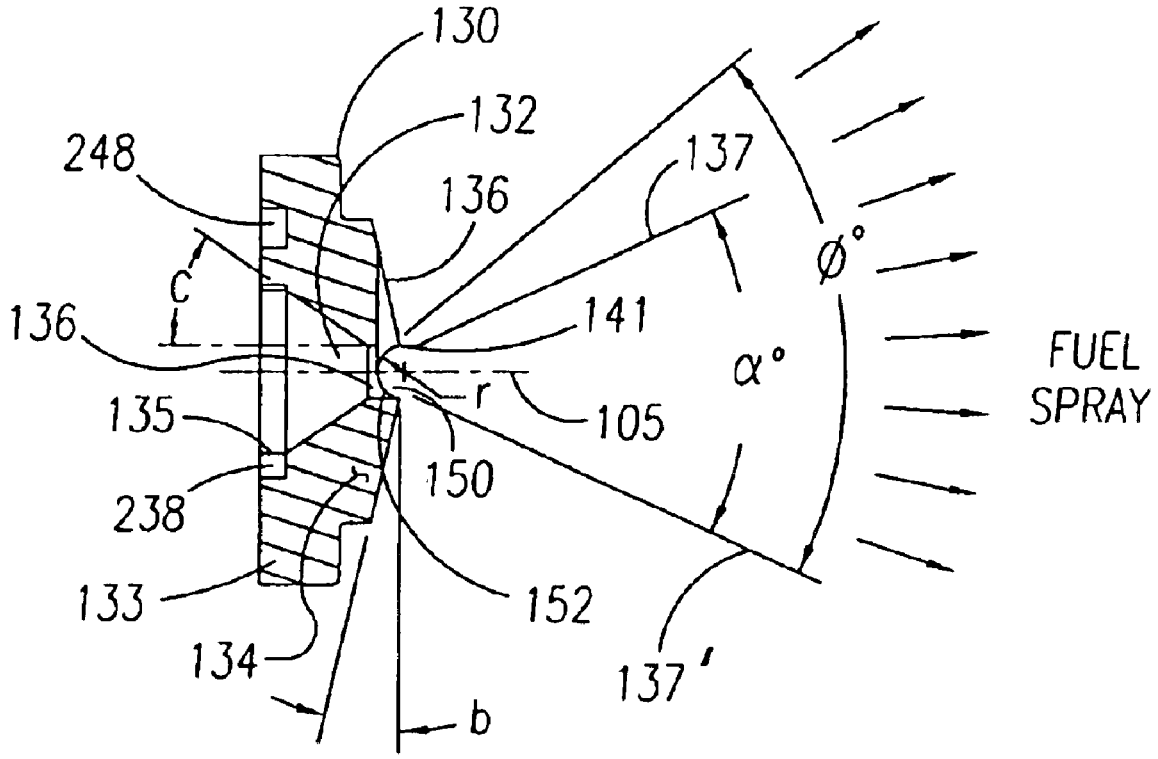
FIG. 3(*a*) is a side cross-sectional view of the atomizer spray plate of FIG. 1(*a*) in accordance with the present invention.
Figure 3B:
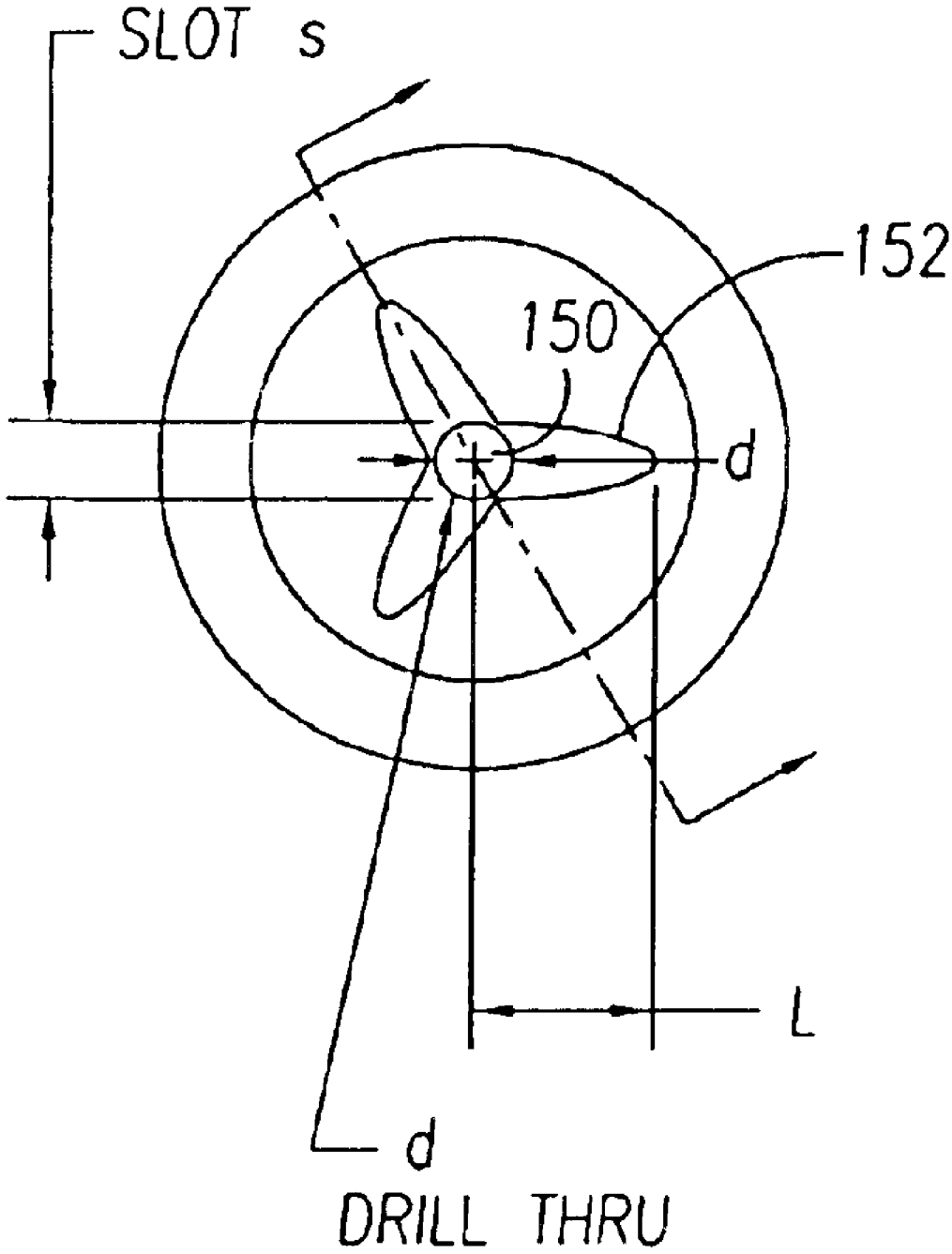

FIG. 3(*a*) is a side cross-sectional view of the atomizer spray plate of FIG. 1(*a*) in accordance with the present invention. The whirl chamber 132 is frusto-conical in shape, and extends at an angle c of approximately 35° from the longitudinal axis 105. However, other angles may be used according to the specific application.

The atomizer spray plate 130 includes a cylindrical base portion 133 and a conical front portion 134. A slot radius r of the semi-circular lobes 152, where r>d/2, is provided to achieve a fuel spray exit cone primary spray angle α. The primary spray angle a may be approximately 20°–40°. The lobes 152 are provided at a depth in the conical front portion 134 such that tangent lines 137 and 137' extend from the edges of the lobes 152 at the desired angle □. The tangent lines 137 and 137' are at an angle of α/2 with respect to the longitudinal axis 105. Note also that the front surface 136 of the atomizer spray plate 130 extends at an angle b of approximately 15° to a vertical line that is perpendicular to the longitudinal axis 105, or equivalently, at an angle of (90-b)° to the longitudinal axis 105.

With the atomizer spray plate 130 of the present invention, a developed secondary spray angle ∅ is achieved along a length-wise direction of each lobe. The secondary spray angle ∅ may be approximately 35°–45° for each of the three lobes 152, with lateral fuel-rich zones on the sides of the lobes and a central fuel-lean zone. In particular, the central fuel-lean zone burns at a faster rate than the lateral fuel-rich zones, thereby resulting in a lower peak flame temperature, and inhibiting the formation of NOx.

FIG. 3(*b*) is a front view of a discharge slot of the atomizer spray plate of FIG. 1(*a*) in accordance with the present invention. The discharge slot or hole 150 has a diameter d as shown. The lobes 152 each have a semi-circular cross-section, and a height s=d. Each of the three lobes 152 extends essentially perpendicular to the longitudinal axis 105 of the discharge slot 150.

It can be determined using simple trigonometric relations that, to achieve the angle α between the tangent lines 137 and 137' of FIG. 3(*a*), the lobe radius r for each lobe should be r=d/(2*cos(α/2)). For example, for α/2=12, r=0.511*d, or just slightly greater than d/2. A drill bit or other cutting tool having the designated radius r should therefore be selected to fabricate the lobes. The length L of each lobe 152 is L=r(cos(α/2)+(1−sin(α/2))/tan(b)). For example, with α/2=12° and b=15°, L=3.9r.

Alternatively, the center point of the drill having a radius r may be provided at a height above the front surface 136 of r*sin(α/2) after the through-hole of diameter d has been provided. Equivalently, the lobes may be provided at a depth below the forward-most point 141 of the front surface 136 of the conical front portion 134 (e.g., in the direction of the longitudinal axis 105) of r(1−sin(α/2)). For example, with α/2=12°, the depth is 0.79r.

The lobes may therefore be provided using known machining techniques in a straightforward and economical manner. Only one cylindrical through-hole is required, and only one transverse cut is made for each lobe or each diametrically opposed pair of lobes. Moreover, further simplifying the fabrication process, the transverse cuts are at right angles to the longitudinal axis of the spray atomizer.

Figure 4:
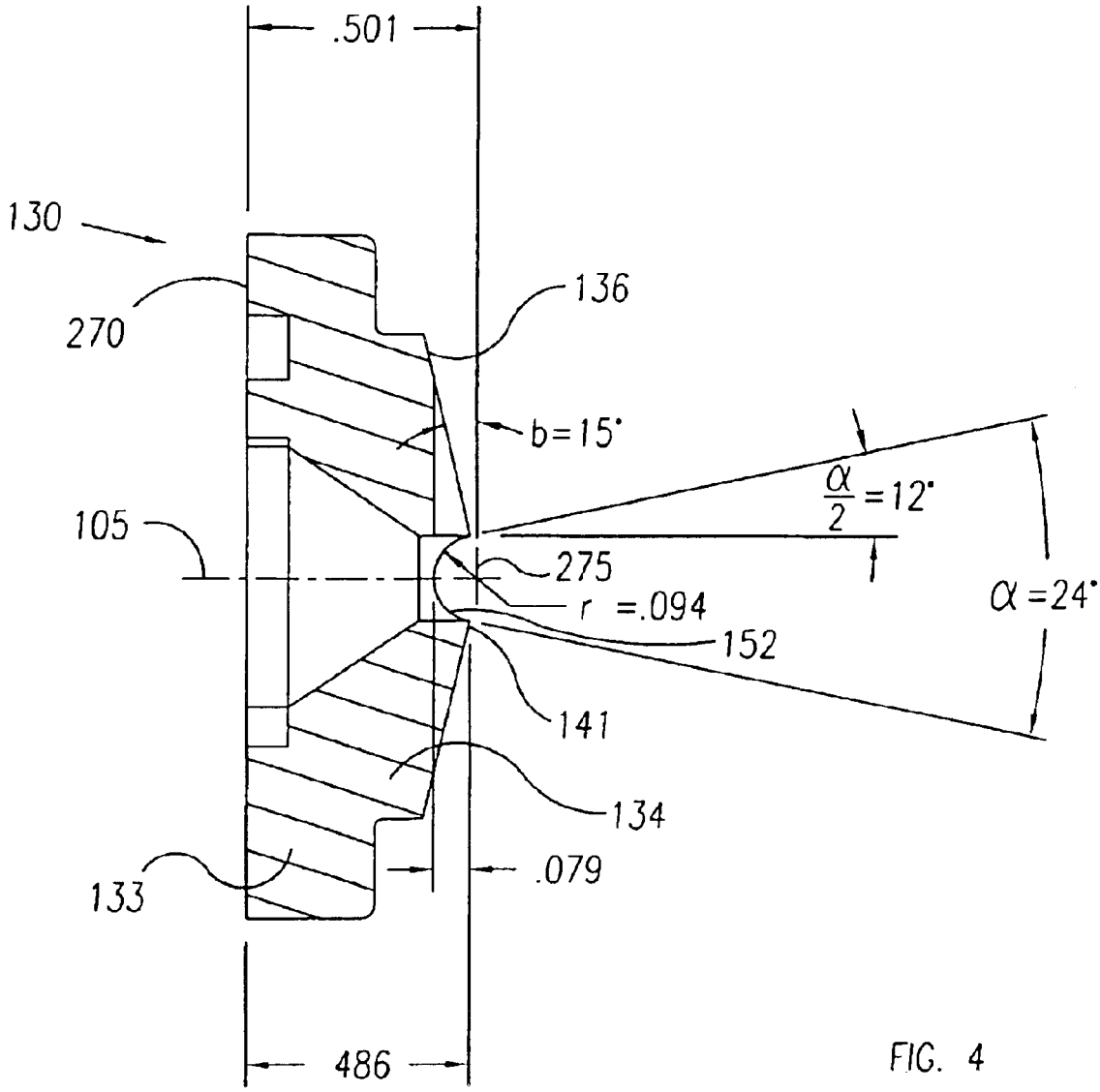
FIG. 4 illustrates example dimensions of a three lobe atomizer spray plate in accordance with the present invention.

FIG. 4 illustrates example dimensions for a three lobe embodiment of an atomizer spray plate in accordance with the present invention. All linear dimensions are in inches. Moreover, while the dimensions shown have been proven successful in testing, the dimension may be scaled or otherwise altered as required for specific applications.

The lobes 152 each have a radius r=0.094 inches, with an imaginary origin of the radius at a point 275. A circular cutting tool used to create each lobe may have a central longitudinal axis that passes through the point 275. In this example, α/2=12°, and b=15°.

Here, using a coordinate system that is parallel to the longitudinal axis 105, the depth of the lobes relative to the forward-most point 141 of the front surface 136 of the conical front portion 134 of the atomizer spray plate 130 is 0.079 inches. A distance between the forward-most point 141 and a back surface 270 of the atomizer spray plate 130 is 0.486 inches. A distance between the imaginary origin 275 of r and the back surface 270 is 0.501 inches. A distance between the imaginary origin 275 of r and the forward-most point 141 is 0.501–0.486=0.015 inches.

Figure 5A:
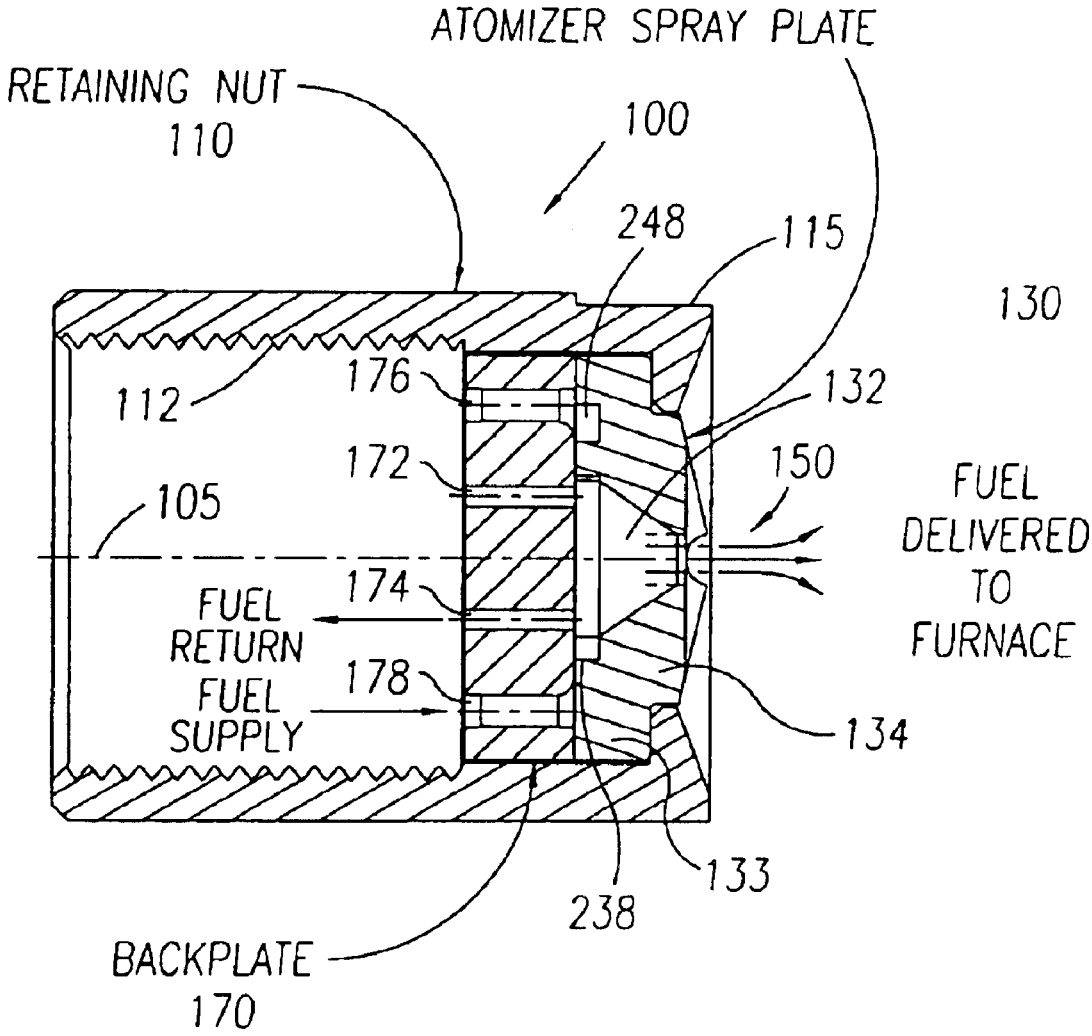
FIG. 5(*a*) is a side cross-sectional view of a four lobe embodiment of an atomizer in accordance with the present invention.
Figure 5B:
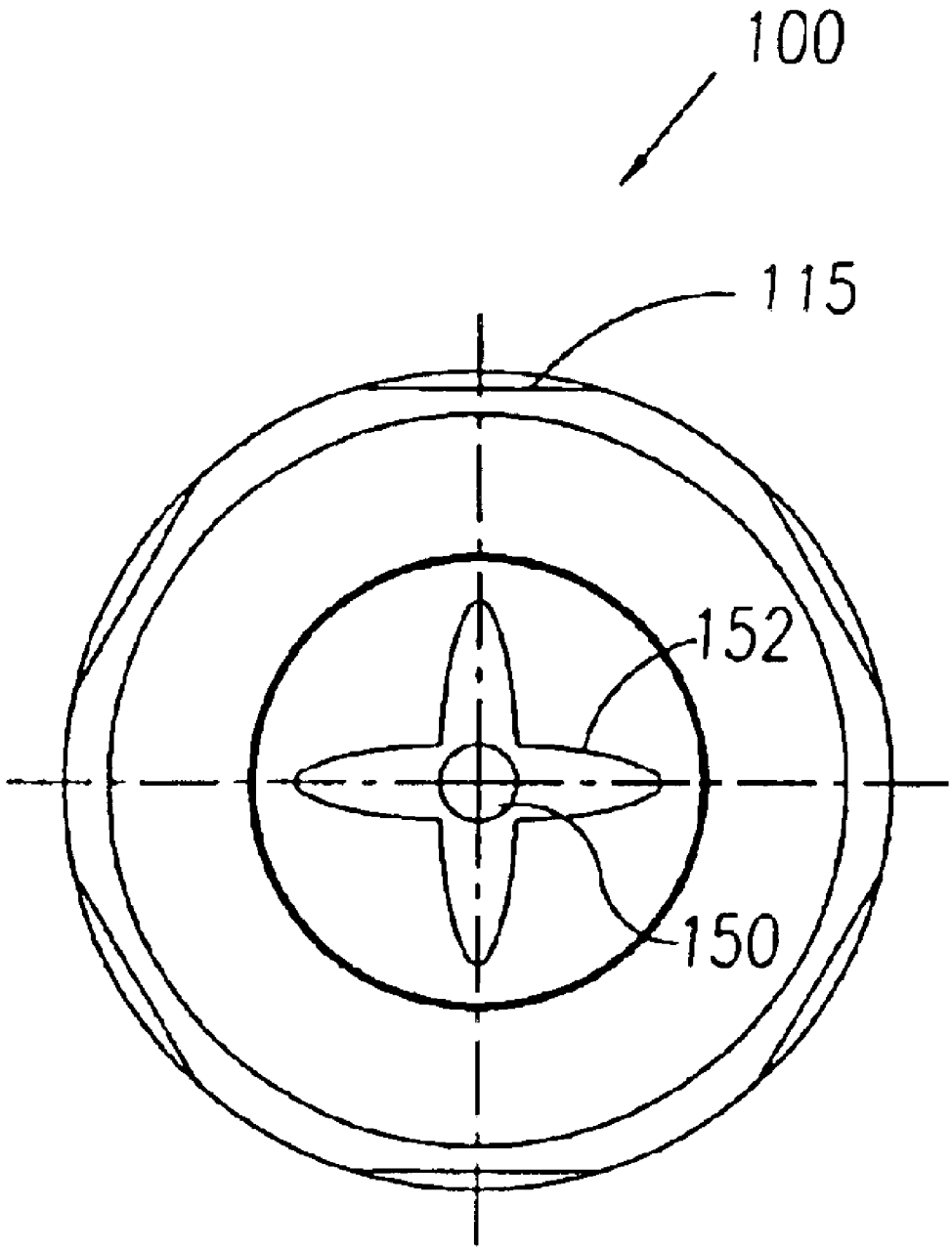
Figure 6A:
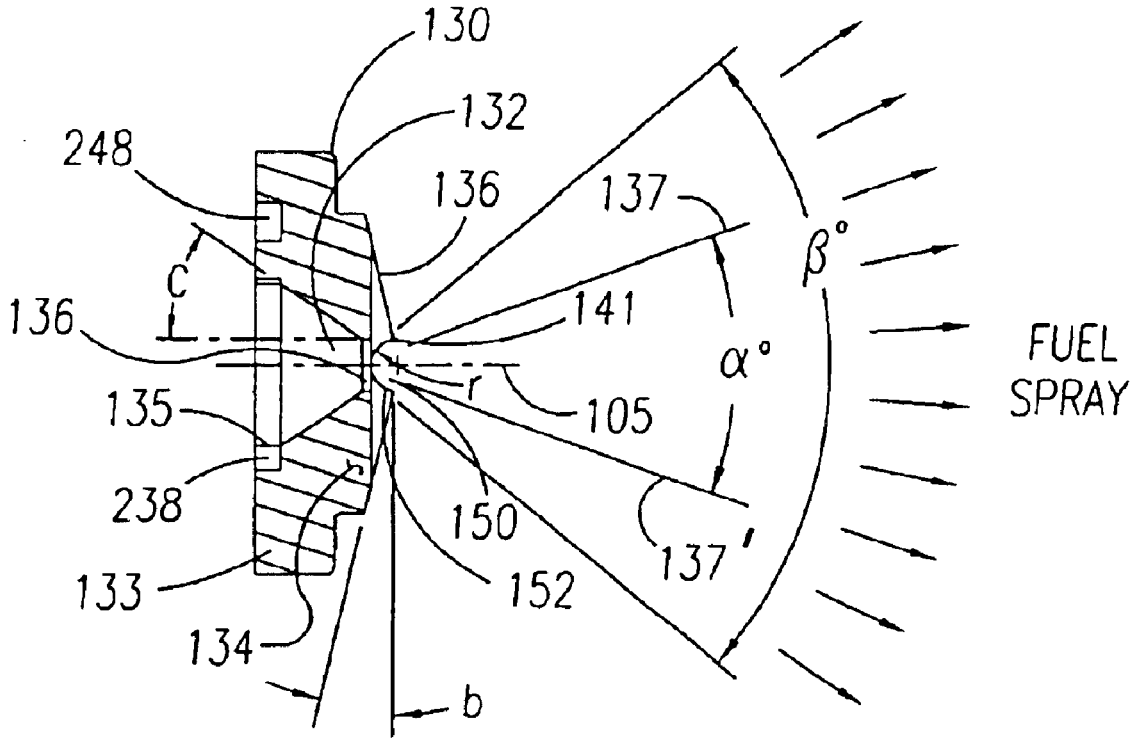
FIG. 6(*a*) is a side cross-sectional view of the atomizer spray plate of FIG. 5(*a*) in accordance with the present invention.
Figure 6B:
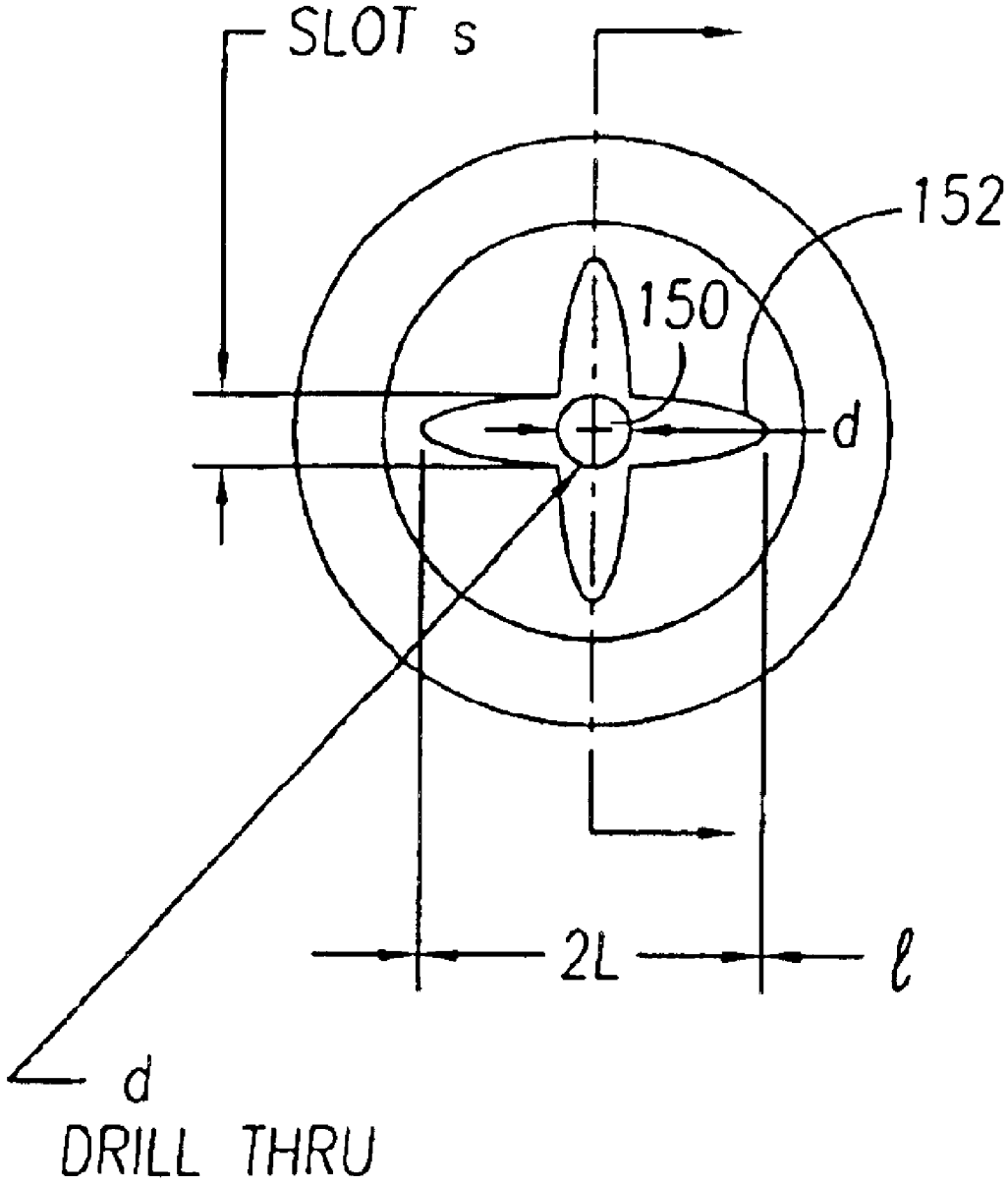

FIGS. 5(*a*) through 6(*b*) illustrate an example four lobe embodiment of the present invention. FIG. 5(*a*) is a side cross-sectional view of an example embodiment of an atomizer in accordance with the present invention having four lobes. FIG. 5(*b*) is a front view of the atomizer of FIG. 5(*a*). FIG. 6(*a*) is a side cross-sectional view of the atomizer spray plate of FIG. 5(*a*). FIG. 6(*b*) is a front view of a discharge slot 150 of the atomizer spray plate of FIG. 5(*a*) in accordance with the present invention.

Like reference numerals in FIGS. 1(*a*) through 6(*b*) refer to like elements. The primary difference between the three lobe embodiment illustrated in FIGS. 1(*a*) through 4 and the four lobe embodiment shown in FIGS. 5(*a*) through 6(*b*) is the number of lobes 152 and the developed spray angle. In terms of performance, the four lobe embodiment will allow for a shorter flame length than the three lobe embodiment, as the atomized fuel oil is dispersed more quickly in direction transverse to the axis 105 of the discharge slot in the four lobe embodiment than in the three lobe embodiment.

In the embodiment shown in FIGS. 5(*a*) through 6(*b*), four lobes 152 are provided, which lobes are equally spaced about the through-hole and oriented in a radial direction to form two pairs of diametrically opposed lobes. A developed secondary spray angle β is achieved along a length-wise direction of each pair of lobes. For example, a developed secondary spray angle β of approximately 70°–90° may be achieved along a length-wise direction of each pair of the lobes 152. The length 1 of each pair of lobes is equal to 2L, where L is the length of each individual lobe 152 and $L=r(\cos(\alpha/2)+(1-\sin(\alpha/2))/\tan(b))$.

FIGS. 2(*a*) and 2(*b*) showing a back view of the spray plate 130 and a cross-sectional view of a whirl slot, respectively, remain the same in the four lobe embodiment as in the three lobe embodiment. In other words, it is only the shape of the area surrounding the discharge slot 150 of the atomizer spray plate 130 that varies in accordance with the number of lobes 152 provided, not the whirl chamber 132 or the whirl slots 238–248.

Figure 7:
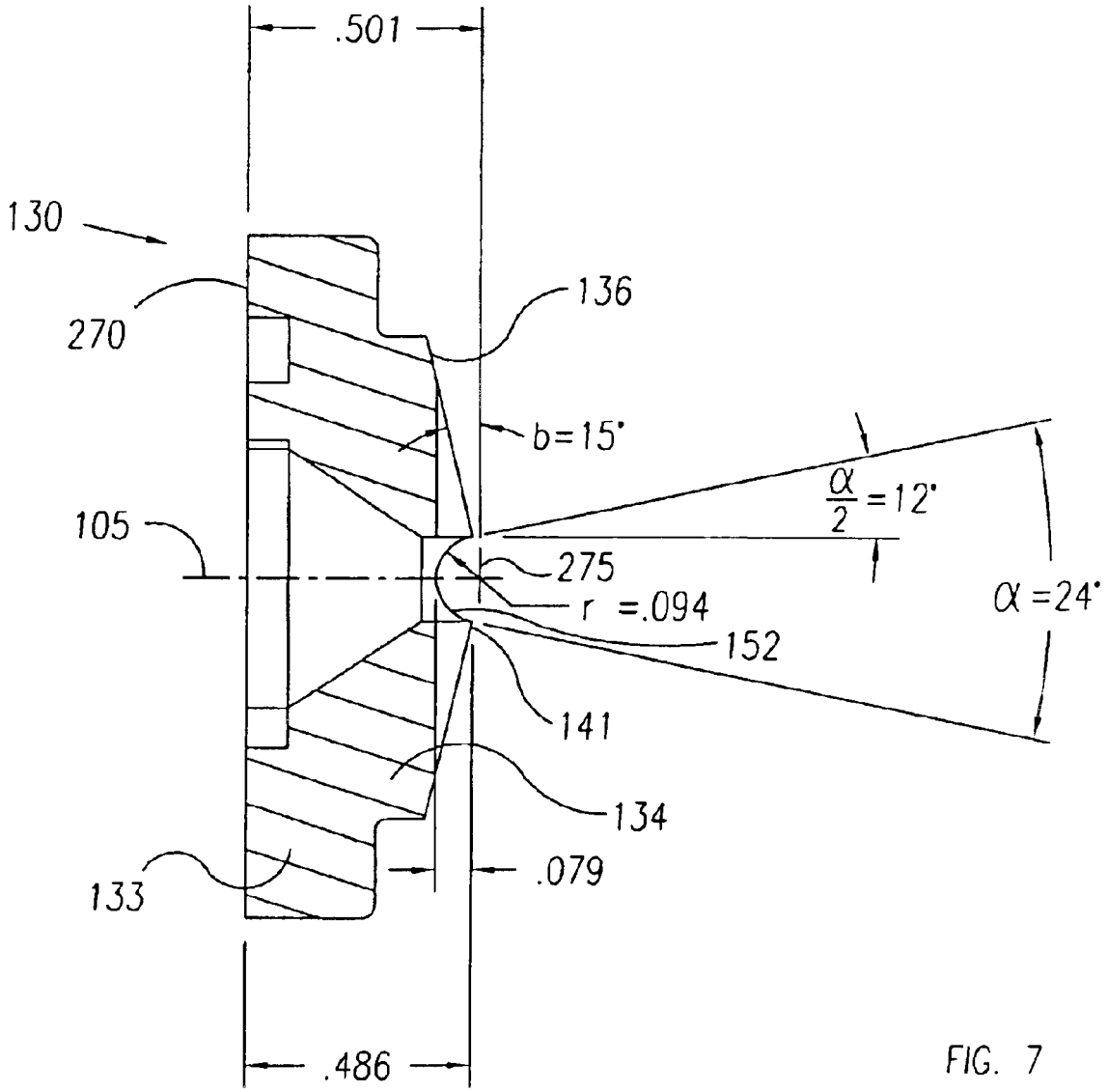
FIG. 7 illustrates example dimensions of a four lobe atomizer spray plate in accordance with the present invention.

FIG. 7 illustrates example dimensions for a four lobe embodiment of an atomizer spray plate in accordance with the present invention. All linear dimensions are in inches. Moreover, while the dimensions shown have been proven successful in testing, the dimension may be scaled or otherwise altered as required for specific applications.

The lobes 152 each have a radius r=0.094 inches, with an imaginary origin of the radius at a point 275. A circular cutting tool used to create each lobe may have a central longitudinal axis that passes through the point 275. In this example, $\alpha/2=12°$, and b=15°.

Here, using a coordinate system that is parallel to the longitudinal axis 105, the depth of the lobes relative to the forward-most point 141 of the front surface 136 of the conical front portion 134 of the atomizer spray plate 130 is 0.079 inches. A distance between the forward-most point 141 and a back surface 270 of the atomizer spray plate 130 is 0.486 inches. A distance between the imaginary origin 275 of r and the back surface 270 is 0.501 inches. A distance between the imaginary origin 275 of r and the forward-most point 141 is 0.501–0.486=0.015 inches.

As shown in the Figures, a fuel atomizer for pressure type atomization systems has been described. Fuel oil is supplied to an atomizer spray plate 130 via passages 176, 178 in a backplate 170. The fuel oil passes through radial whirl slots 238–248 in the atomizer spray plate 130 and into a whirl chamber 132 at a high velocity. Some of the fuel may be returned back to the fuel supply system via fuel return ports 172, 174 while the remaining fuel is delivered to a furnace in a spray pattern with fuel-rich zones separated by a central fuel-lean zone. A large tangential velocity is imparted to the fuel oil by the whirl slots 138–148 to enable the creation of small fuel droplets in the flow delivered to the furnace.

Moreover, a developed secondary spray angle is set by a ratio of tangential momentum to axial momentum as the oil leaves the atomizer. The atomizer spray plate of the present invention has a number of whirl slots having a specific geometry, and is provided with at least three lobes using a unique machining treatment that in effect divides the delivered fuel oil into finely atomized sprays.

A developed secondary spray angle of approximately 35°–45° is achieved along the length-wise direction of each lobe, e.g., perpendicular to a longitudinal axis of the discharge slot of the atomizer. As a result of the tangential forces produced in the whirl chamber 132, the spray pattern produced by each lobe is offset from the lobe by approximately 30° in the direction of the fuel swirl.

Advantageously, the atomizer 100 can be easily fabricated using a minimal number of machining steps. First an atomizer spray plate 130 having a conical front end is provided. A cylindrical through-hole 150 is provided in the center of the atomizer spray plate using a drill bit with a diameter d to form part of the discharge slot of the atomizer. Next, a drill bit or other circular cutting tool having a radius r, where r>d/2, is used to provide the lobes 152 of in the front face of the atomizer spray plate 130 perpendicular to the through-hole 150. The lobes 152 are provided at a specific depth relative to the front face so that the fuel exits the discharge slot 150 to form a fuel spray pattern at a specific primary spray angle α. Equivalently, the length L of the lobes may be set as specified above.

Furthermore, the present inventors have determined that the spray plate reduces NOx particularly when the spray plate is constructed such that a particular ratio "A"/(d*$D_2$) is in a range from 0.4–0.6, where "A" is a total flow area of the whirl slots, and $D_2$ is a diameter of the whirl chamber 132.

Additionally, a particular ratio (h/w) of whirl slot depth h to width w of 1.2–1.3 may be used.

It will now be appreciated that the present invention provides an improved fuel oil atomizer which provides reduced NOx emissions and methods for manufacturing such an improved fuel oil atomizer.

Although the invention has been described in connection with various specific embodiments, those skilled in the art will appreciate that numerous adaptations and modifications may be made thereto without departing from the spirit and scope of the invention as set forth in the claims.

What is claimed is:

1. An atomizer spray plate for discharging fuel oil, comprising:

a rear portion;

a front portion;

a whirl chamber extending from said rear portion to said front portion;

said whirl chamber having a central longitudinal axis extending therethrough;

said rear portion including a plurality of whirl slots extending radially inward from an outboard region of said rear portion to said whirl chamber;

said whirl slots adapted to receive fuel oil at said outboard region and supply the fuel oil to said whirl chamber; and a discharge slot provided in said front portion for receiving the fuel oil from said whirl chamber; wherein said discharge slot comprises:

(a) a cylindrical through-hole with a diameter d having a central longitudinal axis that is co-linear with said central longitudinal axis of said whirl chamber; and (b) at least three lobes equally spaced about the through-hole and oriented in a radial direction, each lobe having a semi-circular cross-section with radius r, said lobes extending approximately perpendicular to said central longitudinal axis of said cylindrical through-hole.

2. The atomizer spray plate of claim 1, wherein:

said front portion has a generally conical front surface surrounding said discharge slot and sloping at a particular angle relative to said central longitudinal axis of said cylindrical through-hole;

said radius r is selected to be greater than d/2; and said lobes are provided at a depth in said front portion to form a desired primary spray angle α that is defined by a tangent line to said lobes at a forward-most point of said front portion.

3. The atomizer spray plate of claim 2, wherein:

said depth is approximately $r(1-\sin(\alpha/2))$.

4. The atomizer spray plate of claim 2, wherein:

said desired primary spray angle α is approximately 20 to approximately 40 degrees.

5. The atomizer spray plate of claim 2, wherein:

said particular angle is approximately 85 degrees.

6. The atomizer spray plate of claim 2, wherein:

$r=d/(2*\cos(\alpha/2))$.

7. The atomizer spray plate of claim 6, wherein:

said depth is approximately $r(1-\sin(\alpha/2))$.

8. The atomizer spray plate of claim 2, wherein:

a developed secondary spray angle is achieved along a length-wise direction of each lobe.

9. The atomizer spray plate of claim 8, wherein:

three lobes are equally spaced about the through-hole and oriented in a radial direction; and the developed secondary spray angle is approximately 35° to 45°.

10. The atomizer spray plate of claim 8, wherein:

four lobes are equally spaced about the through-hole and oriented in a radial direction to form two pairs of diametrically opposed lobes; and the developed secondary spray angle is approximately 70° to 90°.

11. The atomizer spray plate of claim 1, wherein:

said whirl chamber is frusto-conical.

12. The atomizer spray plate of claim 1, wherein:

a portion of the fuel oil in said whirl chamber is returned to a fuel oil supply instead of being supplied to said discharge slot.

13. The atomizer spray plate of claim 1, wherein:

a ratio "A"/($d*D_2$) is in a range from approximately 0.4 to approximately 0.6;

"A" is a total flow area of said whirl slots; and $D_2$ is a diameter of said whirl chamber where the fuel oil is supplied to said whirl chamber from said whirl slots.

14. The atomizer spray plate of claim 1, wherein:

each of said whirl slots has a depth h in a direction parallel to said central longitudinal axis of said whirl chamber, and a width w in a direction perpendicular to said direction of said depth h; and h/w is in a range from approximately 1.2 to approximately 1.3.

15. A method for fabricating an atomizer spray plate for discharging fuel oil, comprising the steps of:

providing an atomizer spray plate having a rear portion and a front portion;

providing a whirl chamber extending from said rear portion to said front portion;

said whirl chamber having a central longitudinal axis extending therethrough; and providing a discharge slot in said front portion for receiving fuel oil from said whirl chamber by providing:

(a) a cylindrical through-hole with a diameter d, and having a central longitudinal axis that is co-linear with said central longitudinal axis of said whirl chamber; and (b) at least three lobes equally spaced about the through-hole and oriented in a radial direction, each lobe having a semi-circular cross-section with radius r, said lobes extending approximately perpendicular to said central longitudinal axis of said cylindrical through-hole.

16. The method of claim 15, comprising the further step of:

providing said rear portion with a plurality of whirl slots extending radially inward from an outboard region of said rear portion to said whirl chamber; wherein:

said whirl slots are adapted to receive fuel oil at said outboard region and supply the fuel oil to said whirl chamber.

17. The method of claim 15, wherein:

said front portion has a generally conical front surface surrounding said discharge slot and sloping at a particular angle relative to said central longitudinal axis of said cylindrical through-hole; and said radius r is selected to be greater than d/2; and said lobes are provided at a depth in said front portion to form a desired primary spray angle $\alpha$ that is defined by tangent lines to said lobes.

18. The method of claim 17, wherein:

said depth is approximately $r(1-\sin(\alpha/2))$.

19. The method of claim 17, wherein:

said desired primary spray angle $\alpha$ is approximately 20 to approximately 40 degrees.

20. The method of claim 17, wherein:

said particular angle is approximately 85 degrees.

21. The method of claim 17, wherein:

$r=d/(2*\cos(\alpha/2))$.

22. The method of claim 21, wherein:

said depth is approximately $r(1-\sin(\alpha/2))$.

23. The method of claim 17, wherein:

a developed secondary spray angle is achieved along a length-wise direction of each lobe.

24. The method of claim 23, wherein:

three lobes are equally spaced about the through-hole and oriented in a radial direction; and the developed secondary spray angle is approximately 35° to 45°.

25. The method of claim 23, wherein:

four lobes are equally spaced about the through-hole and oriented in a radial direction to form two pairs of diametrically opposed lobes; and a developed secondary spray angle is approximately 70° to 90°.

26. The method of claim 15, wherein:

said whirl chamber is frusto-conical.

27. The method of claim 15, wherein:

a ratio "A"/($d*D_2$) is in a range from approximately 0.4 to approximately 0.6;

"A" is a total flow area of said whirl slots; and $D_2$ is a diameter of said whirl chamber where the fuel oil is supplied to said whirl chamber from said whirl slots.

28. The method of claim 15, wherein:

each of said whirl slots has a depth h in a direction parallel to said central longitudinal axis of said whirl chamber, and a width w in a direction perpendicular to said direction of said depth h; and h/w is in a range from approximately 1.2 to approximately 1.3.

* * * * *